United States Patent [19]

Kreager

[11] Patent Number: 4,555,289

[45] Date of Patent: Nov. 26, 1985

[54] METHOD AND APPARATUS FORMING FIN-TYPE BACK SEAL USING COHESIVE SEALANTS WITHOUT EXTERNALLY APPLIED HEAT

[75] Inventor: William D. Kreager, Dallas, Tex.

[73] Assignee: Frito-Lay, Inc., Dallas, Tex.

[21] Appl. No.: 500,189

[22] Filed: Jun. 1, 1983

[51] Int. Cl.[4] ..... B29D 23/10

[52] U.S. Cl. ..... 156/203; 53/451; 53/551; 156/466

[58] Field of Search ..... 156/203, 466; 53/451, 53/482, 550–551, 128, 371

[56] References Cited

U.S. PATENT DOCUMENTS 1,986,422 1/1935 Zwoyer ..... 53/551 X 2,385,897 10/1945 Waters ..... 53/128

3,935,048 1/1976 Rucker ..... 53/551 X

*Primary Examiner*—David Simmons

*Attorney, Agent, or Firm*—Bernard, Rothwell & Brown

[57] ABSTRACT

A method and apparatus for providing a fin-type back seal on packages produced in a vertical form and fill machine utilizes a web having cohesive coating stripes on the edges thereof which are juxtapositioned by forming and then guided to a cold sealing zone. A cold seal assembly with a pressure-biased grooved roller and complementary platen apply rolling pressure to the cohesively striped area without the application of external heat to provide a good seal. The unit is adjustable universally so as provided adaptation to various styles and types of existing machines.

11 Claims, 6 Drawing Figures

FIG. 1
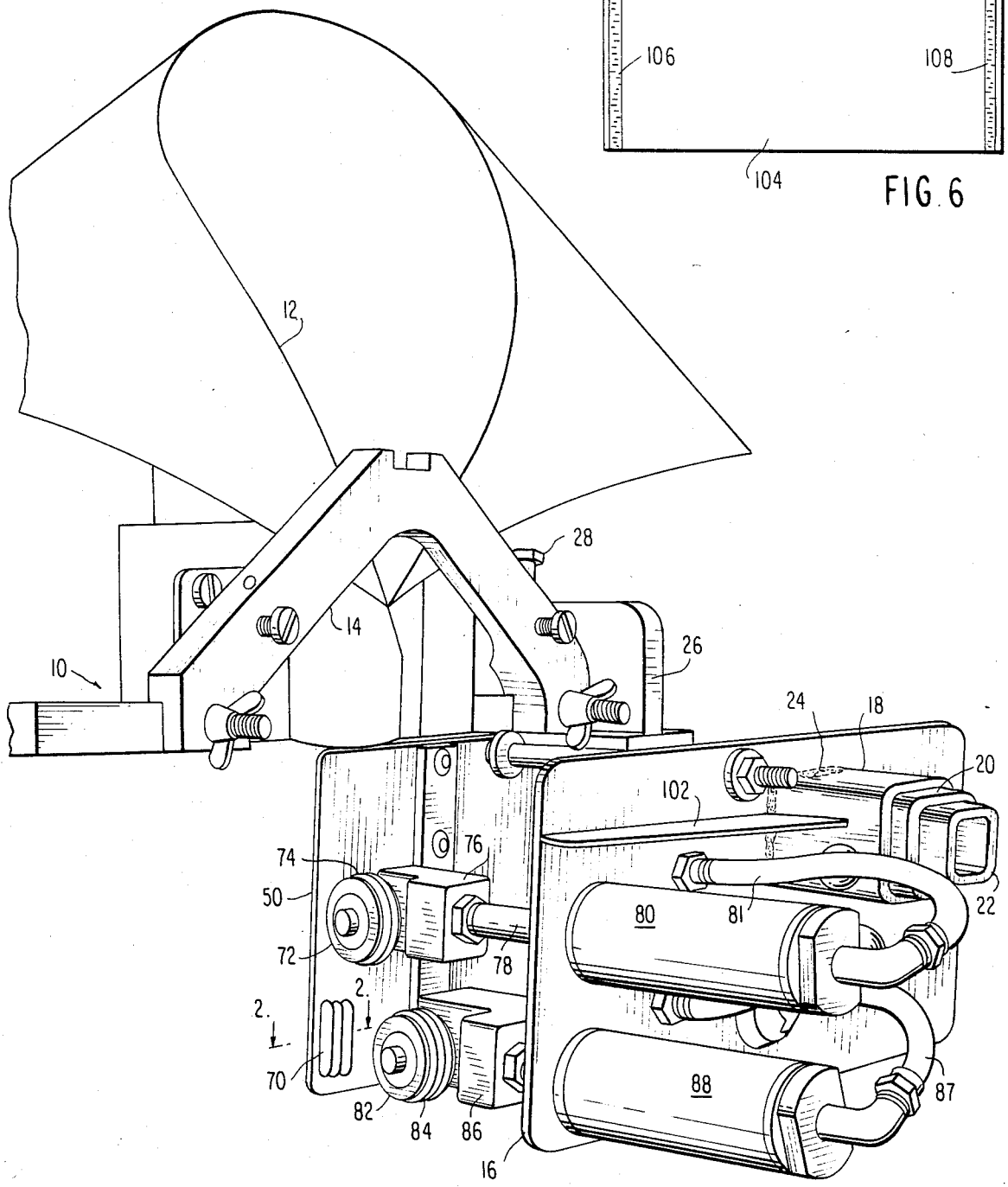
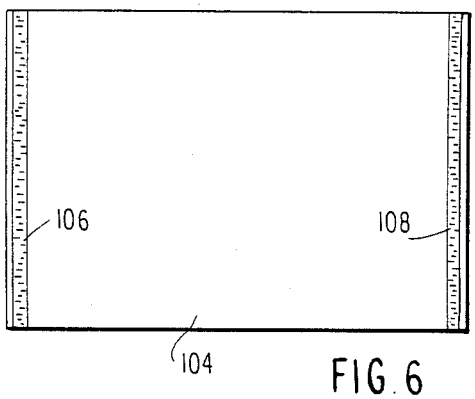
FIG. 6
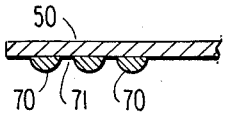
FIG. 2

FIG. 4
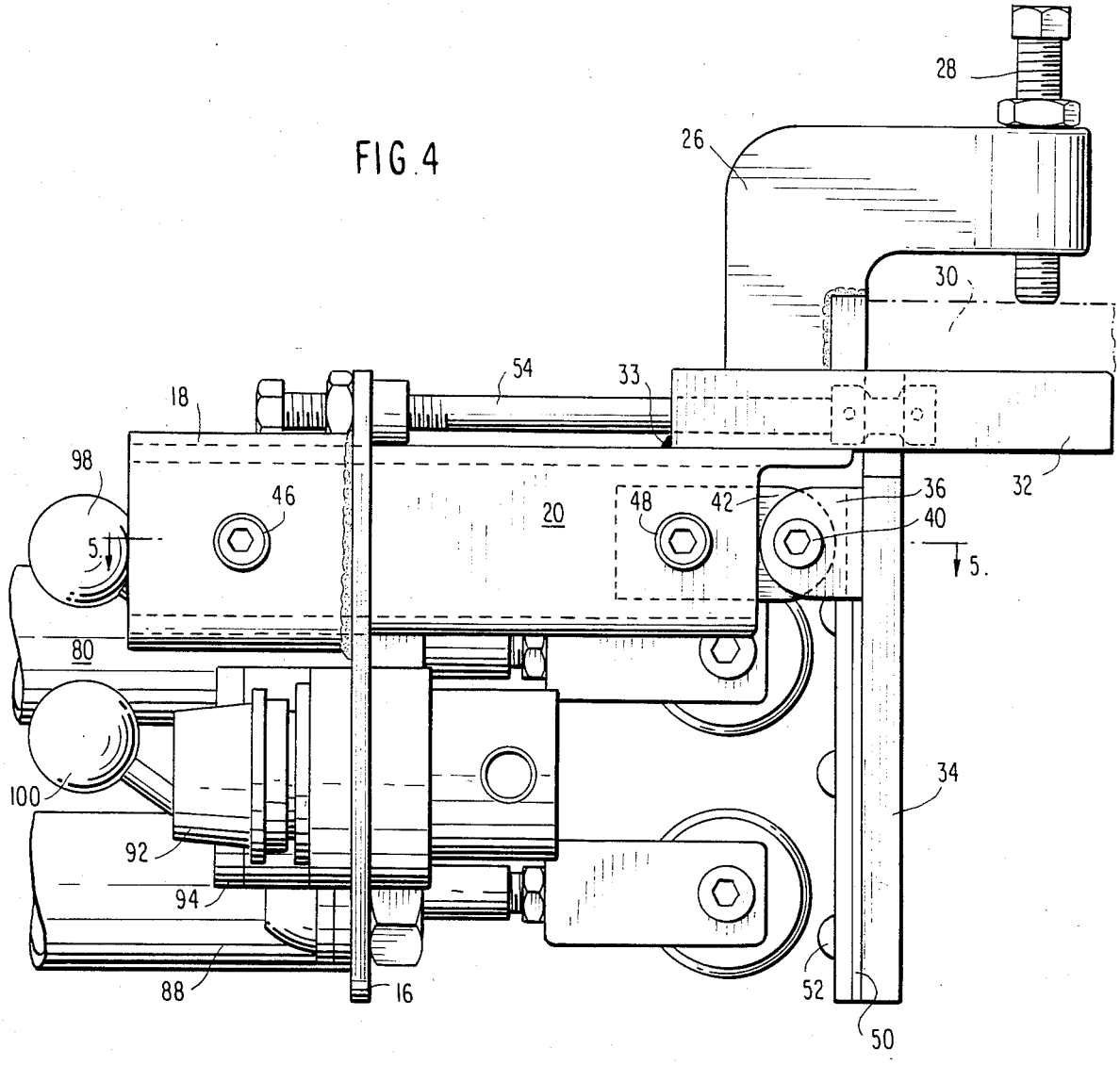
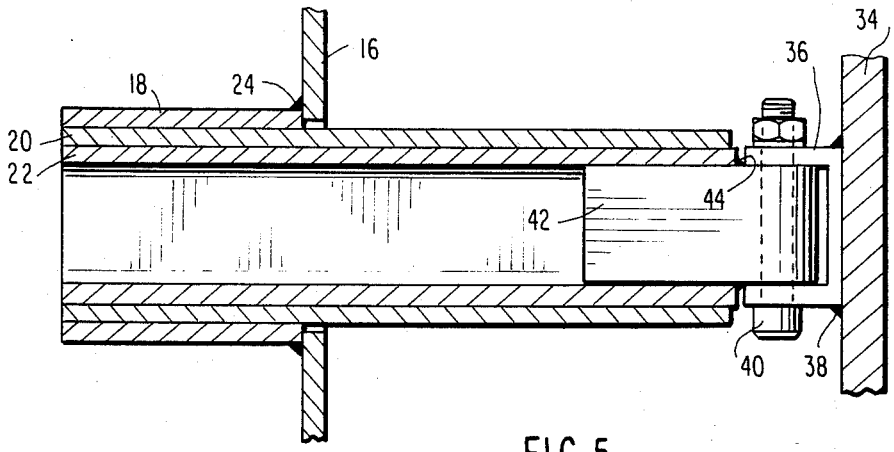
FIG. 5

METHOD AND APPARATUS FORMING FIN-TYPE BACK SEAL USING COHESIVE SEALANTS WITHOUT EXTERNALLY APPLIED HEAT

BACKGROUND OF THE INVENTION

1. Field of the Invention

This invention relates to an improved method and apparatus for providing a back seal on packaging material used in a form, fill, and seal machine. More particulary, the method and apparatus is based on the use of cohesive sealants striped onto the edges of a web forming the package and activated, without the use of external heat, by applying pressure to the sealed area.

2. Prior Art

Form, fill, and seal machines utilize a web of packaging material or film which is moved intermittently and formed into a package while product is packed therein before the package is sealed. Such machines are commercially available, and for a general description of their operation, see the description in expired U.S. Pat. No. 2,899,875 and commonly owned Application Ser. No. 098,961 filed Nov. 30, 1979.

One of the typical known means for providing a back or longitudinal seal in such packaging on the current intermittent motion form, fill, and seal package machines involves the external application of heat and thermally activated film sealants. For example, see the above cited art. The use of heat in sealing produces an inherent limitation on the speed of production because sufficient heat must be transferred through an insulating medium (the packaging film). The transmission of such heat has been a siginficant limitation on package production rates in such machines.

Also, utilizing currently known techniques of heat-sealing in form-and-fill machines, the resultant thermal seals are subject to slip and dwell zone differentials in strength, width, and continuity. In other words, thermal seals produced on the known vertical and intermittent form-and-fill machines, while satisfactory, could stand improvement.

Also, heat-sealing in the environment such as described, requires significant amounts of electrical energy, and is subject to heater and control failures.

Additionally, cohesives not requiring external heat for activation are known sealing items, including packages. However, these cohesives have been generally used with single-ply film with surface printing. They are typically used in horizontal machines and not for packaging loose salted snack products.

SUMMARY OF THE INVENTION

This invention discloses a method and apparatus for providing a fin-type back seal on packaging material used in vertical, intermittent motion form, fill and seal package machines, e.g. machines of the type utilized to package potato chips, corn chips, and similar snack foods. In such packaging operations, the films are typically multi-ply with the printing buried which results in improved appearance and customer acceptance and maintains product freshness. This invention utilizes cohesive coating stripes on or adjacent the edges of the web of the packaging material in lieu of thermally activated sealants for the back or fin seal of such packages. No externally applied heat is used for activating the sealant, instead the application of rolling pressure via grooved rollers produces a slight corrugation in the web and provides for a rubbing or shearing action between the cohesives resulting in a seal with better integrity, and eliminates problems of the slip/dwell differentials in thermal seals. By utilizing a rolling pressure member such as a grooved O-ring roller and backing platen, production speeds can be significantly increased and electrical power requirements significantly reduced over that with prior known heat-sealing arrangements. Additionally, the apparatus used in this invention is adjustable for adaptation to various styles and types of packaging equipment.

BRIEF DESCRIPTION OF THE DRAWINGS

FIG. 1 is a perspective view of the cold seal apparatus of this invention.

FIG. 2 is partial sectional view taken along line 2—2 of FIG. 1.

FIG. 4 is a side elevation view of the cold seal apparatus of this invention.

FIG. 5 is a sectional view taken along line 5—5 of FIG. 4.

FIG. 6 is a plan view of a portion of a web of material with the cohesive material on the edges thereof.

DETAILED DESCRIPTION OF THE PREFERRED EMBODIMENT

Figure 3:
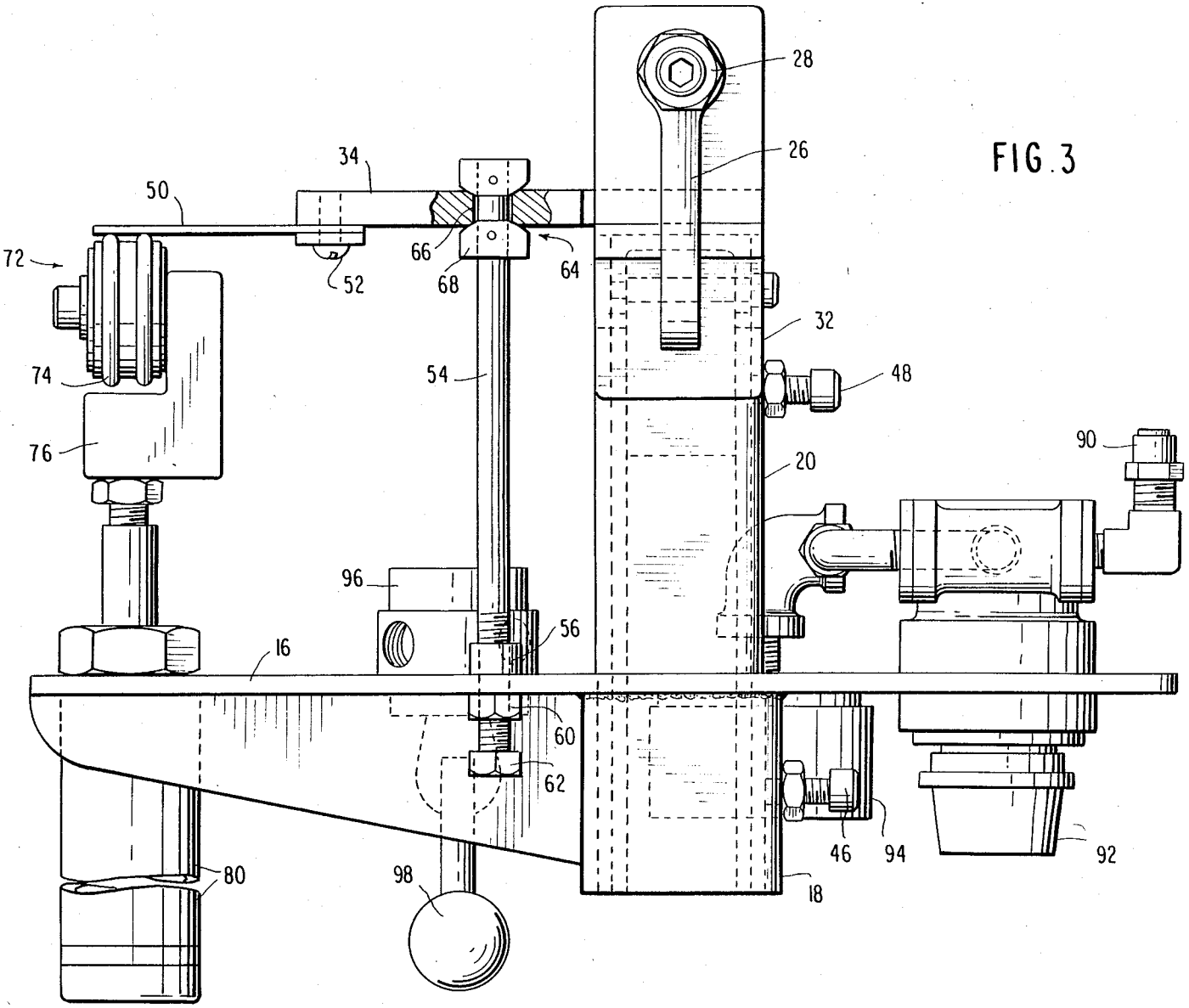
FIG. 3 is a top plan view of the cold seal apparatus of FIG. 1 with a portion broken away and shown in section for illustrative purposes.

With reference to FIG. 1 a form-and-fill machine 10 of either the vertical or slant front type with intermittent motion of the packaging material includes a forming shoe 12, i.e., a conventionl tube former for forming a web of material into a tube as is well known in the prior art. The machine may also have a tongue mounting bracket 16. The form-and-fill machine per se is not part of the apparatus of this invention, and therefore need not be shown or described in detail. The apparatus of this invention attaches to such machine to provide a longitudinal fin seal without the external application of heat, referred to herein as a "cold seal."

The cold seal apparatus of this invention has a main assembly plate 16 to which is welded a hollow tubular member 18 by weld 24. An intermediate telescopic tubular member 20 is slidable inside tubular member 18 and a further telescoping internal tubular member 22 is slidable within telescoping tubular member 20, see FIGS. 1 and 5.

Clamping means are provided for clamping the cold seal apparatus to the conventional form-and-fill machine and includes a clamp-mounting bracket 26 with a clamping screw 28 therein, the clamp-mounting bracket extending upwardly from a clamp base 32. This allows the apparatus to be clamped to a portion 30 of the form-and-fill machine as shown in FIG. 4. The clamp base 32 is connected by weld 33 to the top of telescoping tube 20, see FIG. 4.

A tucker plate base 34 has U-shaped bracket 36 secured thereto by weldment 38, see FIG. 5. The telescoping assembly is pivotably mounted to tucker base 34 by means of a hinge bolt 40 extending through the U-shaped bracket 36 and also extending through a hole in a connector member 42 welded at 34 to the inner telescoping member 22.

For holding the tubular members 18 and 20 in desired adjusted position there is provided a clamping screw 46, and for holding the adjusted position of the tubular members 20 and 22 there is provided a clamping screw 48, see FIGS. 3 and 4.

A tucker plate 50 is formed of very hard thin rigid material such as 0.050 inch thick Swedish clock steel and is attached by a clamping plate and screw assembly 52 to the tucker plate base 34, see FIGS. 1 and 3.

An angular adjusting rod 54 has one end threadably extending through a jam nut 56 positioned against the assembly plate 16. The adjusting rod 54 also has a hex head 62 for adjustment and a lock nut 60 for holding the adjustment. A universal joint 64 is provided at the other end of the adjusting rod 54 where it goes through a universal joint mounting hole 66 in the tucker plate base 34. This universal joint is formed by pivotally pinned stops 68 on both sides of the hole 66 in the tucker plate base 34.

On the tucker plate 50 there is a cold seal platen comprising raised ridges 70 extending vertically and having grooves 71 therebetween as shown in FIGS. 1 and 2.

A tracking or guide wheel 72 is provided with O-ring 74 in its periphery and is rotatably mounted in mounting block 76 which is attached to a piston rod 78 of an air cylinder 80. Air pressure is applied through tube 81 to bias the air cylinder normally downwardly with the O-rings 74 against the tucker plate 50 for tracking and guiding the edges of the formed web of material to be sealed. The mounting is such that the tracking wheel 72 is rotatable about an axis extending longitudinally of the cylinder 80 for assisting in the tracking and guiding.

A compression or seal-forming wheel 82 is also provided with a plurality of O-rings 84 which, for example, may be $\frac{7}{8}''$ ID and $\frac{1}{8}''$ in diameter. These O-rings fit in grooves in the wheel and are positioned such that the periphery of the O-rings cooperate with grooves 71 between the raised ridges 70 on the tucker plate 50. The compression wheel 82 is similarly mounted in a mounting block 86 attached to a piston rod of an air cylinder 88 which has air supplied to it through line 87.

Pressure-regulated compressed air (e.g., at 15–35 PSI) may be supplied to the cold seal assembly through air inlet 90 and is applied to cylinder 88 and to a pressure regulator 92 which may for example be Norgren R06-100RNAA, to supply air to cylinder 80 at a lesser pressure, e.g., 0–15 PSI. An air gauge 94 which e.g., may also be Norgren, monitors the pressure. The air applied to cylinders 80 and 88 (usually at different pressures) is controlled by separate air activation valves. Air activation valve 96 controls the application of air to cylinder 80 through handle operator 98. A similar air activation valve controls the application of air to cylinder 88 via handle 100. These air activation valves may for example be Humphrey 125 V three-way valves and the air cylinders may be Humphrey 6-SH-1 air cylinders.

The support plate 16 and tubular member 18 may be rigidified by reinforcing member 102 shown in FIG. 1.

With regard to FIG. 6 there is shown a web 104 having stripes 106 and 108 on its edges the stripes being of cohesive material. Cohesive coatings no. 207-939, 208-939, 209-939, and 211-939 as produced by Findley Adhesives, Inc. have been found to be capable of providing satisfactory seal property on various seal substrates using the apparatus of this invention.

The pressure applied to the tracking roller 72 from cylinder 80 is usually less than the pressure applied to roller 82 through cylinder 88. The higher pressure on roller 82 is required for forming corrugations and accomplishing the cold seal.

In operation the tube former 12 forms the web 104 with the cohesive striped edges 106 and 108 touching and facing one another. These striped mating edges would be fed downwardly under tracking roll 72 and further under compression roll 82. Differential air pressure is supplied to the cylinder 80 and 88 with the air usually of higher pressure in cylinder 88 causing the O-rings 84 to be forced downwardly against the striped edges of the web and into grooves 71 between the raised ridges 70 on the tucker plate 50. This action causes a corrugation and general working or kneading of the adhesive on the adhesive stripes and causes sealing without the application of heat.

The telescoping assembly of tubular members 18, 20 and 22 together with the clamping assembly 26 and 28 allow the cold seal apparatus to be clamped to various models of known form-and-fill machines now in use in the field so that cold seal apparatus of this invention can be applied to existing machines. In order to adjust the position of the tucker plate 50 universally with regard to the clamped position of the main assembly plate 16 the adjustment rod 54 is utilized together with the universal joint 64 and after ajustment the adjustment is locked in utilizing lock nut 60. Similarly, screws 46 and 48 lock in the telescoping adjustment of the telescoping tubular members 18, 20, and 22.

The cold seal assembly can be applied to existing tube formers and the seal is quickly, easily, and effectively accomplished by the rotary sealing mechanism which applies a constant pressure to the films in the cohesive coatings. The regular unit replaces the standard thermally heated drag block used for fin-sealing in present form-and-fill machines. With the sealing roller and its controlled pressure, and film tracking by the tracking roller, the pressure may be applied to the grooved back-up pressure platen to perform the required seal marriage of cohesive to cohesive. The apparatus provides for universal mounting to meet various requirements and easy telescoping adjustability to meet variation in depths of former designs or types of vertical form-and-fill packing machines.

What is claimed is:

1. Apparatus for providing and forming a cold, fin-type back seal on cohesively edge-striped packaging material used on a vertical or slant form-and-fill machine of the type that forms a web to bring the edges together for sealing and moves the web intermittently through forming and filling stages, the apparatus comprising:

(a) support means attachable to the form-and-fill machine;

(b) a tucker plate carried by the support means and positioned to receive the cohesively striped edges of the web;

(c) a guide means cooperating with the edges of the web on the tucker plate and guiding such to a cold sealing zone on the tucker plate during the longitudinal movement of the web; and, (d) a cold-seal-forming assembly at the cold sealing zone, the cold-seal-forming assembly including means on each side of the web for forming a slight corrugation in the cohesively striped edge to provide a good fin seal without the application of externally applied heat.

2. An apparatus as defined in claim 1, wherein the cold-seal-forming assembly comprises a pressure-biased grooved roller on one side of the web with grooves therein extending longitudinally of the web, and a backing means on the other side of the web for forming the slight corrugations along the striped edge of the web passing therethrough.

3. An apparatus as defined in claim 2, wherein the backing means is a grooved platen on the tucker plate.

4. An apparatus as defined in claim 3, wherein the grooves of the platen extend in the same direction, but are offset from the grooves of the roller.

5. An apparatus as in claim 4, wherein the grooves on the roller are provided by O-rings.

6. An apparatus as in claim 1, wherein the guide means includes a movable roller pivotable about an axis extending perpendicular to the movement of the longitudinal web.

7. An apparatus as in claim 6, wherein the roller has an O-ring surface contacting the web.

8. An apparatus as defined in claim 2, further comprising air pressure means biasing the roller.

9. An apparatus as in claim 1, further comprising adjustable means mounting the support frame to the form-and-fill machine so that the cold seal apparatus may be adapted to fit various configurations of form-and-fill machines.

10. An apparatus as in claim 1 further comprising means for adjustably and universally fixedly supporting the tucker plate relative to the support means.

11. The method of providing a fin-type back seal on packaging material used in a vertical or slant form-and-fill packaging machine, the method comprising:

(a) providing cohesive coating stripes on one side of the longitudinal edges of packaging material being fed through a vertical form-and-fill type package machine;

(b) forming the web containing such cohesive striped coating materials so that the cohesive stripes are juxtapositioned and in contact to provide a longitudinal fin seal area on the packaging material;

(c) guiding the seal area on the packaging material to a cold sealing zone; and, (d) in the cold sealing zone applying an adjustably constant rolling pressure to develop a corrugation in the fin seal without the application of external heat and thereby activating the cohesives to provide a longitudinal fin seal on the packaging material during motion of the packaging material through the form-and-fill packaging machine.

* * * * *